United States Patent [19]

Renkert

[11] 4,031,682

[45] June 28, 1977

[54] PREFABRICATED BUILDING PANEL AND METHOD OF MAKING

[75] Inventor: J. Steven Renkert, Canton, Ohio

[73] Assignee: Metropolitan Industries, Canton, Ohio

[22] Filed: June 22, 1976

[21] Appl. No.: 698,309

Related U.S. Application Data

[62] Division of Ser. No. 569,276, April 14, 1975, Pat. No. 3,965,635.

[52] U.S. Cl. ..... 52/434; 52/744; 52/309.3

[51] Int. Cl.[2] ..... E04B 2/00; E04B 1/00

[58] Field of Search ..... 52/434, 310, 744, 309, 52/747, 749, 743, 315, 617, 621, 612, 600, 125, 385; 404/31

[56] References Cited

UNITED STATES PATENTS

| | | | |
|---|---|---|---|
| 2,595,142 | 4/1952 | Herck | 52/310 |
| 2,825,221 | 3/1958 | Brouk | 52/434 |
| 3,350,827 | 11/1967 | Sugar | 52/744 |
| 3,646,715 | 3/1972 | Pope | 52/309 |
| 3,654,742 | 4/1972 | Wilnau | 52/744 |
| 3,660,214 | 5/1972 | Nichols et al. | 52/309 |
| 3,666,606 | 5/1972 | Stokes | 52/309 |
| 3,965,635 | 6/1976 | Renkert | 52/744 X |

*Primary Examiner*—Price C. Faw, Jr.
*Assistant Examiner*—Robert C. Farber
*Attorney, Agent, or Firm*—Sidney W. Millard

[57] ABSTRACT

A method of making a building panel and the panel made by the steps which include laying a mold form horizontally, laying bricks in the pattern indicated in the mold form and depositing a fibrous and cementitious mixture in the spaces between the bricks and over the tops of the bricks. Providing a reinforcing lattice work and forcing it into the still soft cementitious mixture. Subsequently, a resin insulating material is foamed in situ in the mold cavities formed between the elements of the lattice work. Optionally, a smooth finish coat of material may be troweled or sprayed over the insulation material.

8 Claims, 8 Drawing Figures

PREFABRICATED BUILDING PANEL AND METHOD OF MAKING

BACKGROUND OF THE INVENTION

This is a division of application Ser. No. 569,276, filed Apr. 14, 1975, now U.S. Pat. No. 3,965,635.

The art of brick making is thousands of years old and an integral part of the process is the firing. Since the Second World War many brick companies have used natural gas as a fuel for firing the brick. As is well known, there is now a shortage of natural gas and as a consequence, modified procedures are necessary.

Additionally, a need has arisen in modern construction for eliminating or minimizing the great expense of labor in brick laying. In response to the need, prefabricated panels or brick work have been provided and the panels are suitable for unit assembly to form interior and exterior walls of buildings. Unfortunately, the mass of the typical prefabricated brick panel is such that rather heavy machinery is required for moving the panels from one place to another.

It is an object of this invention to provide a prefabricated building panel and a specific process for making the panel such that the cost of the brick to make the panel and the panel itself are less expensive, the panel is of lighter weight and the resulting panel may be structurally more or less rigid than conventional brick and mortar walls, depending on whether the wall is to be load bearing or merely a curtain wall.

BRIEF DESCRIPTION OF THE INVENTION

The panel itself includes fired ceramic or brick or cementitious facing units or the like. For convenience the facing units will hereinafter be referred to as "bricks" but the word is intended to include all such units. As is well known to those having ordinary skill in the brick making art, the firing time for a given brick is geometrically proportional to the shortest dimension between exposed faces. Obviously, a one-quarter brick requires much less firing time than a conventional size brick with the resultant savings in fuel costs.

The facing bricks are deposited on a horizontal mold form which includes indicia thereon to indicate proper placement of the bricks. It is intended that the final product should look like a conventional brick wall laid by hand; thus, the bricks are all spaced apart. To enhance the authentic appearance of the brickwork, some suitable means is provided to fill the spaces between the bricks near their downward face, thereby preventing any portion of subsequently deposited cementitious layers from migrating to the front brick face.

Mortar composition is mixed with fibers (glass, steel, nylon, etc.) and is used to fill the spaces between the bricks and provide a first layer on the upwardly facing back portion of the bricks. A lattice work may be provided of criss-crossing beams and shafts welded or otherwise joined at their intersections and of appropriate cross-section for minimizing flexure. The lattice work is pushed into the first cementitious layer at the backs of the bricks while the grout is still soft. Prior to the deposition of mortar-fiber composition, an appropriate adhesive may be sprayed or otherwise applied over the exposed surfaces of the bricks and between the bricks to minimize migration of mortar to the front, enhance the bonding of the cementitious mixture, and to provide a barrier in the spaces between the bricks to at least partially block exposed fibers from view from the front face of the panel. Next, a homogeneous aqueous mixture of cement and fibers is sprayed over the lattice work, first cementitious layer and the exposed brick to bond the lattice work to the bricks. The fibrous nature of the cementitious layers will anchor the lattice work in place when the second layer is properly bonded to the first layer.

If desired, a variety of insulation materials may be applied to the panel by depositing the insulation material in the cavities formed between the shafts and beams of the lattice work. A preferred insulation material which is effective both for sound as well as heat insulation is foamed polyurethane which is foamed in situ to a depth approximating the height of the lattice work. It will be recognized that if a properly rigid insulation layer can be properly bonded to the brick work the lattice work might be eliminated. Further, various insulation materials may be used instead of foamed polyurethane as will be understood by technicians in the field.

It may be desired to put a finish coat of some material on the back of the insulation material for aesthetic purposes. Another spray coat of the fibrous mixture may be applied if desired; and in view of the properites of the fibrous material observed, it is clear that such a spray coat of said glass fiber material would give some added strength to the panel although such added strength would be unnecessary for any conventional purposes.

The reasons for increased strength and flexibility of the fibrous mixture as compared to a conventional layer of concrete is explained in a January, 1962 article entitled *Two-Phase Materials* by Games Slayter published in *Scientific America*, pages 124–134; and to the extent necessary for a full understanding of this invention, the article is incorporated herein by reference.

DESCRIPTION OF THE PREFERRED EMBODIMENTS

This invention will be described with reference to glass fibers and it is recognized that special treatment of the fibers may be necessary to prevent their chemical deterioration or agglomeration during mixing. Such problems and suggested solutions are a part of U.S, Pat. Nos. 2,738,285; 2,793,130; 3,062,670; 3,147,127; and 3,716,386; and to the extent necessary for a full understanding of this invention, said patents are incorporated by reference. Uses of steel and other kinds of fibers in concrete and the like are described in U.S. Pat. Nos. 3,429,094; 3,500,728; 3,650,785 and 3,808,085; and to the extent necessary for a full understanding of this invention, they are also incorporated by reference.

For convenience, the invention herein will be described by the process of making the building panel of this invention.

Figure 1:
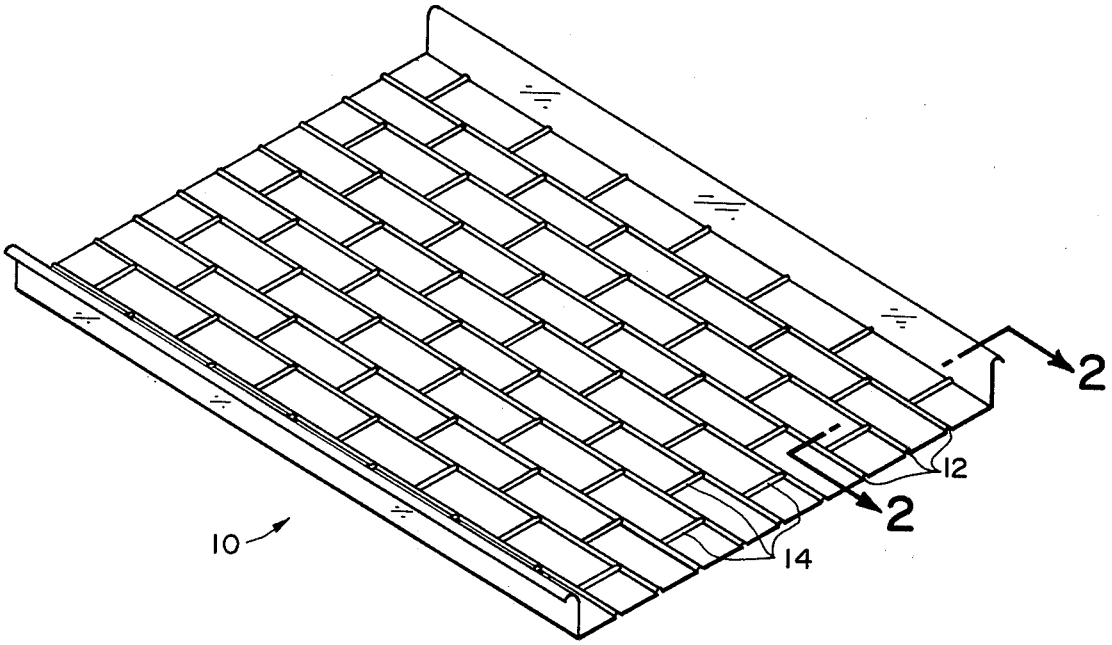
FIG. 1 is a perspective view of a horizontal mold on which are to be deposited facing bricks suitable for the manufacture of a prefabricated building panel.
Figure 2:
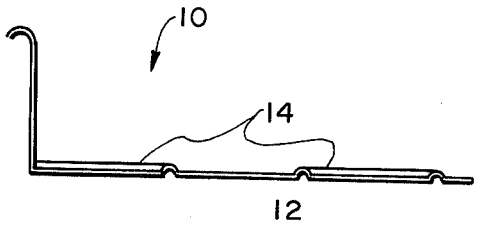
FIG. 2 is a fragmentary sectional view of a portion of the mold form of FIG. 1 taken along line 2—2.

With reference specifically to FIG. 1, a mold form 10 is first laid horizontally on some supporting structure adequate to support the weight of the building panel after it is constructed. While there are a number of possible types of molds which might be used for this invention without departing from the spirit thereof, for convenience a plastic shell is illustrated including longitudinal ridges 12 and transverse ridges 14 to serve as indicia to indicate where the facing bricks 16, as illustrated in FIG. 3, should be located and as a means to fill the spaces between the placed bricks to minimize migration of grout to the front 18 of the panel.

Figure 3:
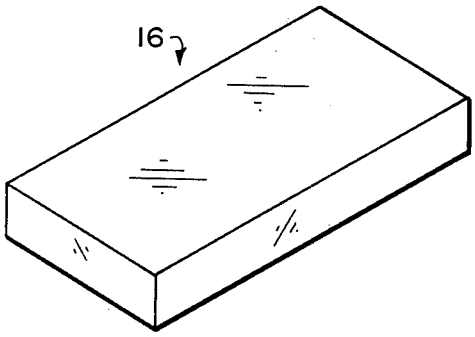
FIG. 3 is a perspective view of a thin brick used in the manufacture of the prefabricated panel of this invention.
Figure 4:
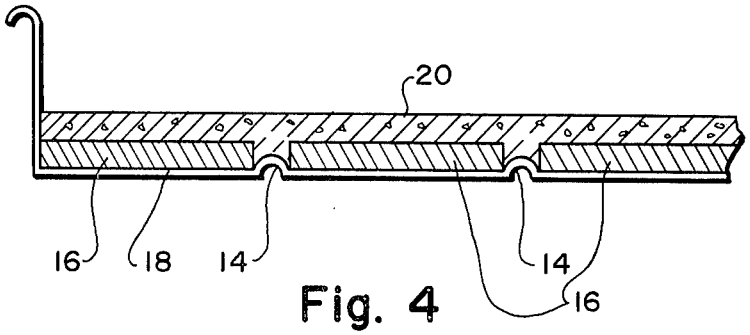
FIG. 4 is a fragmentary sectional view similar to FIG. 2 but with the facing brick and layer of mortar-fiber mixture deposited thereon.

It will be observed that the brick 16 illustrated in FIG. 3 is thin relative to a conventional brick. In fact, it is only about ⅛ – 1 inch in thickness. Bricks 16 are placed in the cavities between ridges 12 and 14 (or between other indicia means indicating proper brick placement). In the absence of ridges 12 and 14, some other means should be provided to minimize the migration of grout to the front fact 18 of the bricks. Rods could be laid between the bricks or any other suitable means could be used. However, in the illustrated embodiment the ridges 12 and 14 are slightly tapered and serve that purpose. Therefore, when a layer of mortar 20 (actually an aqueous mixture of cement and glass fibers) is deposited by spraying or otherwise depositing over the bricks, after the mold 10 is removed and the exposed faces 18 of the bricks are inspected they will appear conventional with the hardened concrete slightly recessed from the brick face. Because of the minimal thickness of the bricks 16, the mortar layer 20 will be recessed from the exposed face of the bricks at most about one eighth of an inch. As with any cement operation, it is desirable to lightly spray the brick surface with water before a cement mixture is deposited to prevent absorption of water from the cement mix. Other sequential depositions of cement mixes may be preceded by a water spray as needed. Alternatively, an adhesive spray may be used.

At this point in time, the panel with the single layer of mortar and glass fibers may be used as a curtain wall without any further treatment. Such a wall would weigh only about 5–6 lbs./ft$^2$ but it would be rather flexible. The fact that the mixture of cement and glass fibers, properly applied, is capable of bonding the bricks together is significant because the back surfaces are not necessarily especially grooved or mechanically roughened to enhance the bonding, although some roughening or grooving would be acceptable. Note also that the brick panel will "flex" without breaking at the mortar line between bricks which is contrary to conventional concrete layers. The flexing is due to the tension strength of the glass fibers.

Assuming a desire for a load bearing or more rigid panel, the next step in the procedure is the laying of the lattice work 22 over the bricks and cementitious layer. It should be emphasized that no particular configuration of lattice work is preferred over another in terms of effectiveness except that the structural forms are required to have greater rigidity than merely round rods welded together at their juncture. Rigidity must be achieved by use of the lattice work because of the relatively thin wall formed by the thin bricks. The flexing of the prefabricated wall should be kept at a minimum where such is detrimental to its intended use; and as a consequence, it is necessary that the structures forming the lattice work be more rigid than a round rod (which, in combination with the thin wall, is inadequate).

Figure 5:
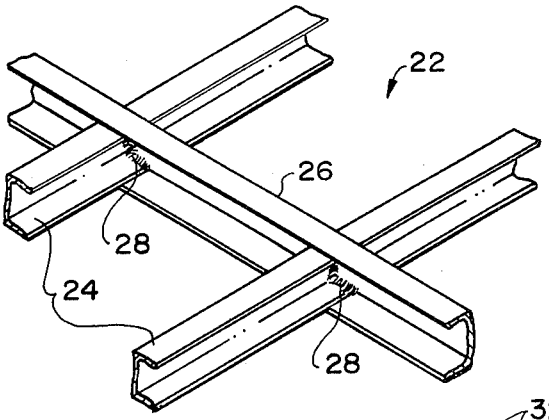
FIG. 5 shows on modification of U-shaped metallic beams and shafts bonded together to form a lattice work which is subsequently to be joined to the facing brick of FIG. 4.
Figure 6:
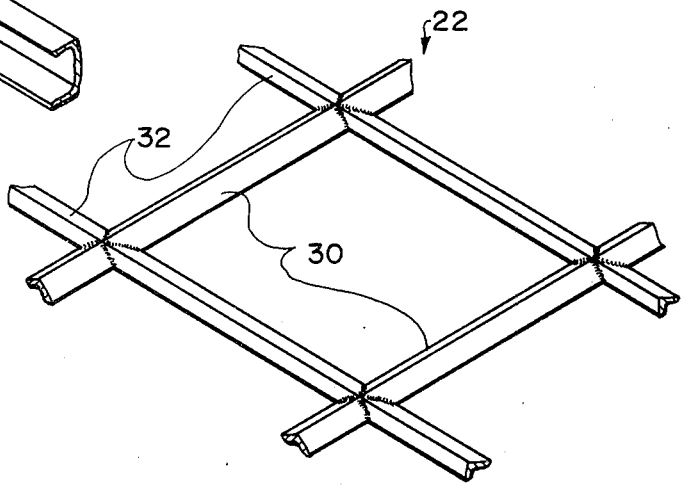
FIG. 6 is an alternative structure of lattice work which may be substituted for the structure of FIG. 5.

FIGS. 5 and 6 show two modifications which are merely illustrative but are effective for the purposes intended.

FIG. 5 illustrates beams 24 of U-shaped configuration intersected by U-shaped shafts 26. In this case the beams and shafts are metallic and are welded together at their juncture 28. It is clear that other materials and shapes could be used but for purposes of convenience only the U-shape of FIG. 5 and V-shape of FIG. 6 have been illustrated.

FIG. 6 illustrates beams 30 and shafts 32 and functionally they are equivalent of the beams and shafts 26 and 28, respectively, of FIG. 5.

Figure 7:
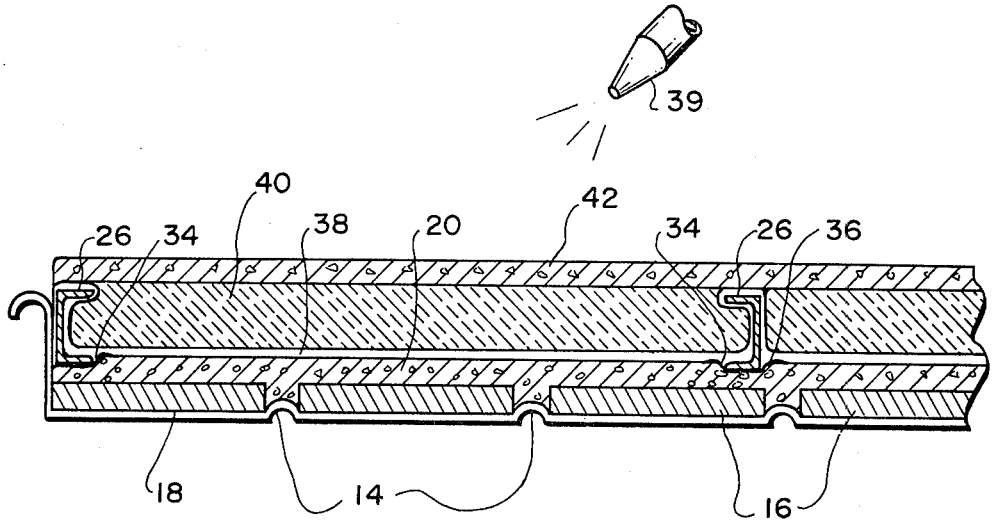
FIG. 7 is a fragmentary sectional view similar to FIG. 4 but with the lattice work bonded to the facing brick and with the insulation and facing coat applied.

Observing FIG. 7, the lattice work 22 is laid on the surface of the mortar 20 and preferably pressed therein to provide an enhanced anchor between the lattice work and the mortar layer. On pressing the lattice work inward, small grooves 34 will be formed and a bulge of the mortar at 36 will extend upwardly and perhaps slightly over the portion of the lattice work pressed into the mortar.

Next a mixture of cementitious material is sprayed as a layer 38 over the exposed surfaces of the lattice work, mortar, and any portion of the bricks remaining exposed. The ingredients of the sprayed cementitious mixture are the same as the first mortar layer 20 and they are significant as the solidified mixture provides some unique structural properites. The ingredients are roughly as follows:

| Ingredients | Amounts | |
|---|---|---|
| Type 1 Portland cement | 58.5 | pounds |
| Hydrated lime | 11.25 | pounds |
| Calcium stearate | 0.75 | pounds |
| Glass fiber (about ½ inch length) | 3 | pounds |
| Water | 36 | pounds |
| | 109.50 | pounds |

The ingredients come premixed and are sold under the trademark BlocBond (a trademark of Owens-Corning Fiberglass Corporation). It is obvious that a range of modified mixtures could be used but the indicated ingredients are preferred with the weight ratio of cement to glass fibers being about 20 to 1. The glass fibers in this instance provide a unique feature in that with the ingredients enumerated above, the cementitious mixture bonds to the glass fibers as well as to the first mortar layer 20 and the lattice work. The glass fibers tend to strengthen the mass in tension and tend to bridge gaps which may exist in the deposited layer 38. It is important that the length of the glass fibers not be substantially greater than ½ inch because when the fibers are too long they may tend to clog the spray nozzle 38. It is clear that the mixture could be deposited in a number of ways over the lattice work including troweling, brushing, etc., but equally clear is that spraying will be far superior in terms of time spent in depositing the second cementitious layer 38.

The preferred mixing or blending procedure for the ingredients which are to be sprayed on the backs of the thin bricks is as follows:

a. The dry cement, lime and calcium stearate are blended in a conventional cement mixing apparatus for 15–30 seconds and the fibers are added slowly to insure even distribution;
b. Water is added to a drum-type mortar mixer (35 to 38 lbs.);
c. With the mixer running, about half the dry blend is dumped into the water and mixed for about 15 seconds;
d. The remainder of the dry blend is slowly added and a final mix for 60 to 90 seconds will insure a smooth uniform consistency.

Excessive mixing tends to cause the fibers to agglomerate with resulting lumps. Lumps preclude spraying, and while deposition of the lumpy mixture by outer means is possible, the resulting layer will not have a uniform consistency or surface.

The thickness of the layer 38 should not be greater than about ⅛ to ¼ inch for maximum efficiency. One-eighth inch thickness will give strength and bonding characteristics to the extent necessary for proper operation of this invention. A greater thickness will not be particularly detrimental to the structure but it should be recognized that a greater thickness will not add anything structurally to the panel.

The lattice work forms another useful function. It should be considered desirable to insulate the wall panel, as for example in an office building where the wall panel is to face outward and the lattice work will be near the inside surface. In such an instance, insulating material 40 may be placed in the cavities between the beams and shafts forming the lattice work. A number of different kinds of insulation are suitable but the preferred insulation is polurethane foamed in situ. In FIG. 7, the foamed polyurethane is deposited to a depth approximately equal to the height of the lattice work.

If desired, an inside facing coat 42 of some sort may be applied over the foamed polyurethane 40. It is recognized that the facing coat 42 could be another spray coat of the cement-fiberglass mixture, in which case it would add a certain amount of strength to the structure but under any conceivable normal circumstances such added strength is not required.

Figure 8:
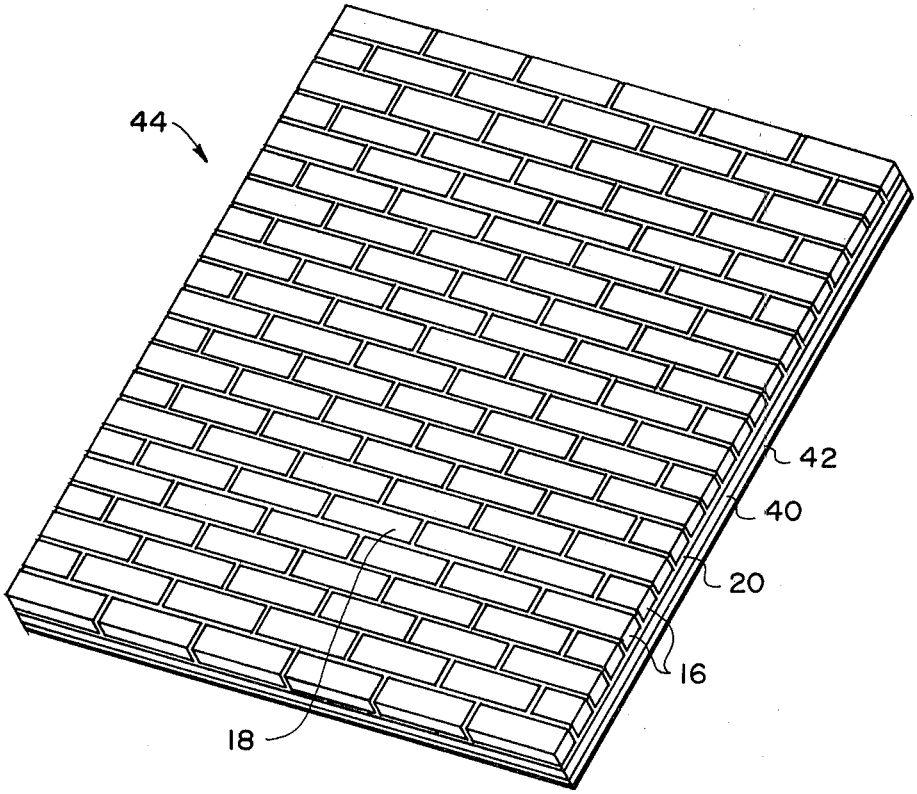
FIG. 8 is a perspective view of the front of the prefabricated building panel of this invention.

After the materials have all cured, the mold 10 is removed and the prefabricated panel 44 illustrated in FIG. 8 is suitable for use as an interior or exterior wall in conventional construction. It may be assembled with other similar walls if desired.

No discussion has been had with respect to temperatures and wetting down of the cementitious materials subsequent to their deposition. In the preferred embodiments, the panels are manufactured in a controlled environment in a factory. In such an instance, it is obvious that the temperature, humidity, and other environmental factors may be controlled relatively closely. Where the assembly of the panel structure is not under such controlled conditions, it may be necessary to wet down the panel again within 24 hours of the time the initial cementitious mixtures are laid. Also it should be emphasized that the temperature should always be above freezing but below a temperature which would dry the ceent mixtures too quickly.

Having thus described the invention in some detail, it will be obvious to those having ordinary skill in the art that certain modifications could be made without departing from the spirit of the invention. Additionally, the language used to describe the invention is not intended to be limiting, rather it is intended that the only limitations to be placed on the invention are those set out in the appended claims.

I claim:

1. A wall panel including a plurality of ceramic, masonary or the like facing bricks spaced apart but bonded together by a first cementitious mixture deposited and hardened in the spaces separating the bricks, the cementitious mixture covering a rear portion of some of the bricks but none of the front portion, a lattice work of beams and shafts joined to both the back portions of at least some of the bricks by the bond of said cementitious mixture and to each other by welding, at least some of the beams and shafts being of a cross-sectional shape other than round, thereby providing a more rigid composite panel, a layer of a second cementitious mixture at least partially covering the exposed surface of the lattice work, bricks and the first cementitious mixture, said layer helping to join the lattice work to the facing bricks, said second cementitious mixture including hydrated cement and glass fibers, said layer having a thickness not substantially greater than ¼ inch.

2. The panel of claim 1 including a layer of insulation material, said insulation material being disposed juxtaposed to the layer of said second cementitious mixture and in the cavities formed between the beams and shafts.

3. The panel of claim 2 including a layer of cementitious material applied over said insulation material to encapsulate said insulation material.

4. The panel of claim 2 wherein the insulation material is a resin foamed in situ to bond to the layer of the second cementitious mixture.

5. The panel of claim 4 wherein the thickness of the foamed resin is approximately the thickness of the lattice work which serves as a mold form for the resin during its fluid stage.

6. The panel of claim 1 wherein the glass fibers are approximately ½ inch in length.

7. The wall panel of claim 1 including an adhesive layer between the bricks and the first cementitious mixture serving to enhance the bonding between the two.

8. The wall panel of claim 1 wherein the weight ratio of cement to glass fibers is about 20 to 1.

* * * * *